US007975578B2

(12) United States Patent
Youtsey

(10) Patent No.: US 7,975,578 B2
(45) Date of Patent: Jul. 12, 2011

(54) TOOL FOR INSTALLING AND REMOVING MALE F-TYPE COAXIAL CABLE CONNECTOR

(75) Inventor: Timothy L. Youtsey, Scottsdale, AZ (US)

(73) Assignee: PCT International, Inc., Mesa, AZ (US)

( * ) Notice: Subject to any disclaimer, the term of this patent is extended or adjusted under 35 U.S.C. 154(b) by 283 days.

(21) Appl. No.: 12/453,401

(22) Filed: May 11, 2009

(65) Prior Publication Data

US 2010/0282030 A1 Nov. 11, 2010

(51) Int. Cl.
*B25B 23/14* (2006.01)
*B25B 13/00* (2006.01)

(52) U.S. Cl. ..... 81/467; 81/472; 81/124.2; 81/124.5; 81/125.1; 81/64; 81/177.6

(58) Field of Classification Search ..... 81/124.2, 81/124.4, 124.5, 124.7, 125.1, 64, 467, 472, 81/177.6–177.8
See application file for complete search history.

(56) References Cited

U.S. PATENT DOCUMENTS

| | | | | |
|---|---|---|---|---|
| 1,092,574 | A * | 4/1914 | Jansson | 464/37 |
| 1,164,073 | A * | 12/1915 | Cunningham | 81/472 |
| 1,464,128 | A * | 8/1923 | Coes | 81/64 |
| 1,571,148 | A * | 1/1926 | Sisolak | 81/124.5 |
| RE16,354 | E * | 5/1926 | Carlberg | 81/124.5 |
| 1,613,976 | A * | 1/1927 | Bellows | 81/124.5 |
| 1,613,981 | A * | 1/1927 | Carlberg | 81/124.5 |
| 3,837,244 | A * | 9/1974 | Schera, Jr. | 81/64 |
| 4,505,171 | A * | 3/1985 | Chang | 81/124.5 |
| 5,301,575 | A * | 4/1994 | Mehlau et al. | 81/124.7 |
| 5,507,211 | A * | 4/1996 | Wagner | 81/472 |
| 5,797,300 | A * | 8/1998 | Fairbanks | 81/60 |
| 6,439,086 | B1 * | 8/2002 | Bahr | 81/467 |
| 6,637,299 | B1 * | 10/2003 | Steele | 81/124.5 |
| 6,817,272 | B2 * | 11/2004 | Holland | 81/124.2 |
| 7,024,970 | B2 * | 4/2006 | Boman | 81/177.8 |
| 7,080,581 | B2 * | 7/2006 | Reese | 81/475 |
| 7,347,129 | B1 * | 3/2008 | Youtsey | 81/467 |
| 2006/0150784 | A1 * | 7/2006 | Hsieh | 81/125.1 |

* cited by examiner

*Primary Examiner* — D. S Meislin
(74) *Attorney, Agent, or Firm* — Perkins Coie LLP

(57) ABSTRACT

A tool includes a first and a second socket wrench pivotally turnably connected to two ends of a link. Each of the first and second socket wrenches includes a wrench portion and a circular end portion having an axial slot extended through them. The wrench portion of the first socket wrench is internally formed of a hexagonally shaped portion for fitting around a hexagonally-shaped outer surface of a connecting ring of a male F connector to tighten or loosen the connecting ring to or from a female F connector, and the wrench portion of the second socket wrench is internally formed of a constant-torque shaped portion for fitting around the hexagonally-shaped outer surface of the connecting ring to prevent the tool from applying an excessive torque on the connecting ring when turning the same. The tool can be used without being hindered by bent or closely arranged cables.

9 Claims, 8 Drawing Sheets

TOOL FOR INSTALLING AND REMOVING MALE F-TYPE COAXIAL CABLE CONNECTOR

FIELD OF THE INVENTION

The present invention relates to a tool for installing or removing a male F connector to or from a female F connector.

BACKGROUND OF THE INVENTION

Screw-on F-type connectors are used on most RF coaxial cables to interconnect TV's, Cable TV decoders, VCR/DVD's, hard disk digital recorders, satellite receivers, video games, TV signal distribution splitters and switches. Initially, F cables (an RG-6 or RG-59 type coaxial cable with an F-type male connector at each end) were used in simple installations to interconnect a TV to a cable box, VCR or video game, with ample room between the devices to interconnect the cables by hand. The space behind such devices permitted a large bend radius for the cable between or behind the devices. For example, an RG-6 cable requires a minimum bend radius of 3 inches as specified by manufactures.

Due to space limitations imposed by the increased number of TV devices that are now interconnected in one small, high-density space or console, it has become difficult to install and remove the interconnecting F cables without first removing the device from the congested area or console. Many of these devices, such as large screen TV sets, are now positioned as close to a wall as possible forcing the F cables to make sharp bends in order to interconnect the cable to an adjacent device. As artisans skilled in the art of cable installation will appreciate, it is both the sharp bends formed in the semi-rigid coaxial F cables and the high density of these cables in current installations that have made the present means for installing, un-installing, tightening and loosening F-type connectors difficult and time consuming. It is the intention of this invention to provide a novel solution to this new density problem.

F connectors have a standardized design, using a 7/16 inch hex nut as the rotational connecting ring. The nut has a relatively short 1/8 to 1/4 inch length available for finger contact. The internal threads on the nut and matching F female are a 3/8-32 thread, requiring the male connector to be positioned exactly in-line with the female connector for successful thread engagement as rotation begins. When the cable extends rearwardly from the connector and is both in-line with the threaded outer surface of the female connector and straight for some distance, aligning the male connector in the proper plane is not difficult. However, when the cable is bent adjacent to the male F-type connector, as is the case where the rear-mounted F connector on the device is adjacent a wall or cabinet surface, the installer must first straighten the cable for some distance so that the F male connector on that cable can easily screw onto the female connector.

The F male connector in accordance with the prior art is designed to be screwed onto and off of the F female connector using the fingers. The hex shaped nut is provided for wrench tightening the connector after the male F connector is fully screwed onto the female F connector by the fingers (usually 4 turns). To maintain a tight electrical connection and to meet the intended electrical performance, manufacturers and industry standards require the F connector to be tightened beyond the torque achievable by using only the fingers. In the case of cable TV products, the standard has been set to tighten the connector and then further turn the connector by another 90-120 degrees from the finger tight position. Consumer products which have weaker female mounting structures (usually plastic) require their F connectors to be wrench-tightened just slightly beyond finger tight. When the cable is bent, the torque required to install or remove a male F connector is increased. There is a need for a tool operable for providing the additional torque required for the installation or removal of the male F connector when the attached cable is in a bent position.

There are currently two tools and methods for using the tools for tightening and loosening F connectors. A first tool is a standard open-end 7/16 inch crescent wrench with a minimum shaft length of 4-6 inches. The use of this tool requires an unobstructed area for radial rotation of the tool around the axis of the F-type connectors once the threads on both male and female have been engaged. Sufficient radial open space is rarely available on TV devices where many other connectors and cables project from a device and occupy a small area.

The second tool, originally designed to install F cables through security devices in a cable system, are currently used to install F cables in dense locations. This tool consists of a 7/16 inch hex nut driver socket with a slot on the side to allow the socket to slide over an installed cable. The disadvantage of this tool is that the cable must be in a straight line with the male and female connectors being mated. This condition is no longer the typical installation situation; making this tool ineffective for its intended use. There is a need for a tool that can be used to connect and disconnect male F connectors in high cable density applications.

Zamanzadeh, in U.S. Pat. No. 5,992,010, discloses a coaxial cable connector tool that includes a hollow elongated housing comprised of two halves hinged together. The halves are closed around a female coaxial cable connector. When the halves are closed, a hexagonal hole is formed at one end, and another hole is formed at the opposite end. The hexagonal sleeve on the connector is snugly positioned in the hexagonal hole, and the cable is positioned through the opposite hole. The sleeve is then rotated by turning the housing by hand. The housing is substantially wider than the sleeve on the connector, and includes a hexagonal outer surface, so that it may be easily gripped and turned by hand. In a second embodiment, the housing is provided as a built-in component on new connectors.

As mentioned earlier, when an F cable is bent, the torque required to loosen the connector nut increases five fold, making it almost impossible to unscrew with the fingers without the benefit of a mechanical advantage. Notwithstanding the recognition of the problem in the prior art and the tools devised to solve the problem, a commonly practiced method for cable installation is to remove the TV or similar device from the console cabinet or move it away from a wall, thereby allowing the cable to straighten; making the connection with the fingers, with or without a tool, and then returning the device into the confined space.

Modern TV-related product interconnections are now made in tight spaces such as home master distribution boxes, inside home entertainment consoles, behind TV/VCR stands, etc. where most, if not all, of the coaxial cables are bent immediately from the plane of attachment to the device in order to most efficiently reach the device connected thereto. Accordingly, there is a current need for a tool for connecting and disconnecting male F-type connectors that is operable in confined spaces and provides the desired torque under conditions wherein the cable is bent adjacent to the connector.

SUMMARY OF THE INVENTION

A primary object of the present invention is to provide a tool for installing or removing a male F connector on a coaxial cable to or from a female F connector on an electronic device.

Another object of the present invention is to provide a tool for conveniently and exactly connecting a male F connector to a female F connector to achieve an effect much better than tightening the male F connector using fingers.

A further object of the present invention is to provide a tool for installing or removing a male F connector, with which a user can select to use a socket wrench simply for tightening and loosening or a socket wrench for providing a constant torque. With the socket wrench providing a constant torque, it is able to avoid the problem of applying an excessive torsion on the male F connector.

The male F connector generally includes a connecting ring and a sleeve assembly, and is connected at a tail end to an end of a coaxial cable to provide an F-type coaxial cable structure. The connecting ring is rotatably located at a leading end of the male F connector and has a threaded inner surface and a hexagonally-shaped outer surface, and the coaxial cable is extended outward from the tail end of the male F connector.

To achieve the above and other objects, the tool for installing or removing a male F connector according to the present invention includes a first and a second socket wrench pivotally turnably connected to two ends of a link. Each of the first and second socket wrenches includes a wrench portion and a circular end portion. The wrench portions each are a tubular element having a leading end, a tail end, and a hollow wrench body located between the leading and the tail end. The wrench body of the first socket wrench is internally formed of a hexagonally shaped portion for fitting around the hexagonally-shaped outer surface of the connecting ring of the male F connector to tighten or loosen the connecting ring to or from a female F connector. The wrench portion of the second socket wrench is internally formed of a constant-torque shaped portion for fitting around the hexagonally-shaped outer surface of the connecting ring to tighten or loosen the connecting ring to or from a female F connector. Once the torque for tightening the male F connector exceeds a preset tightening torque value, the constant-torque shaped portion will separate from the hexagonally-shaped outer surface of the connecting ring and no longer tightly fit therearound. In this situation, the tool can no longer be used to continuously turn the connecting ring. The first and second socket wrenches each have a slot extending a full length thereof. The circular end portions each are a hollow element having a leading end and a tail end. The leading ends of the circular end portions are connected to the tail ends of the wrench portions.

The tool according to the present invention can be conveniently used with bent coaxial cables or in an environment with densely arranged coaxial cables to install or remove one male F connector on a coaxial cable to or from a female F connector on an electronic device.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
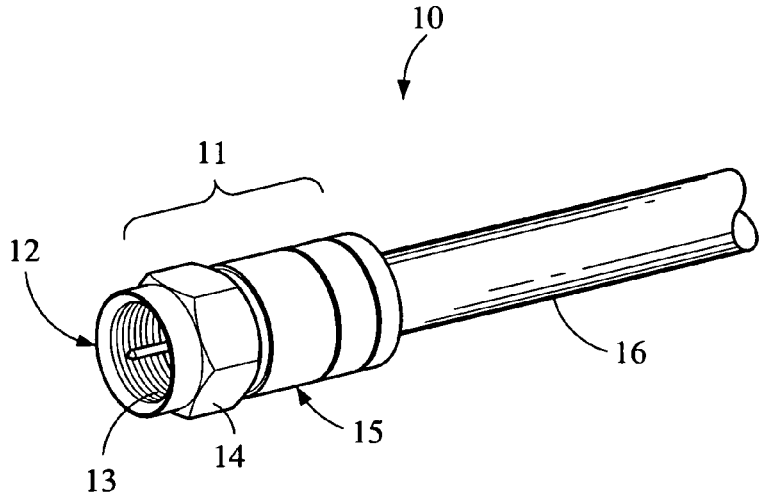
FIG.1 PRIOR ART
FIG. 1 is a perspective view of an F-type coaxial cable structure having a coaxial cable and a male F connector connected thereto.

Please refer to FIG. 1, which is a perspective view of an F-type coaxial cable structure 10 having a male F-type coaxial cable connector 11, which will also be briefly referred to as a male F connector 11 throughout this document, and a coaxial cable 16. The male F connector 11 has a rotatable connecting ring 12 located at a leading end thereof and a sleeve assembly 15 located behind the connecting ring 12. The connecting ring 12 has a threaded inner surface 13 and a hexagonally-shaped outer surface 14, so that the connecting ring 12 can be turned at the hexagonally-shaped outer surface 14 by a tool, such as a wrench (not shown), to tighten to or loosen from a female F connector. The coaxial cable 16 shown in FIG. 1 is in a straight state and extended from a tail end of the male F connector 11. Generally, in the process of installing the male F connector 11, the coaxial cable 16 will become bent in the proximity of the male F connector 11 to cause considerable inconvenience in manipulating the conventional crescent-shaped wrench for tightening or loosening the connecting ring 12.

Figure 2:
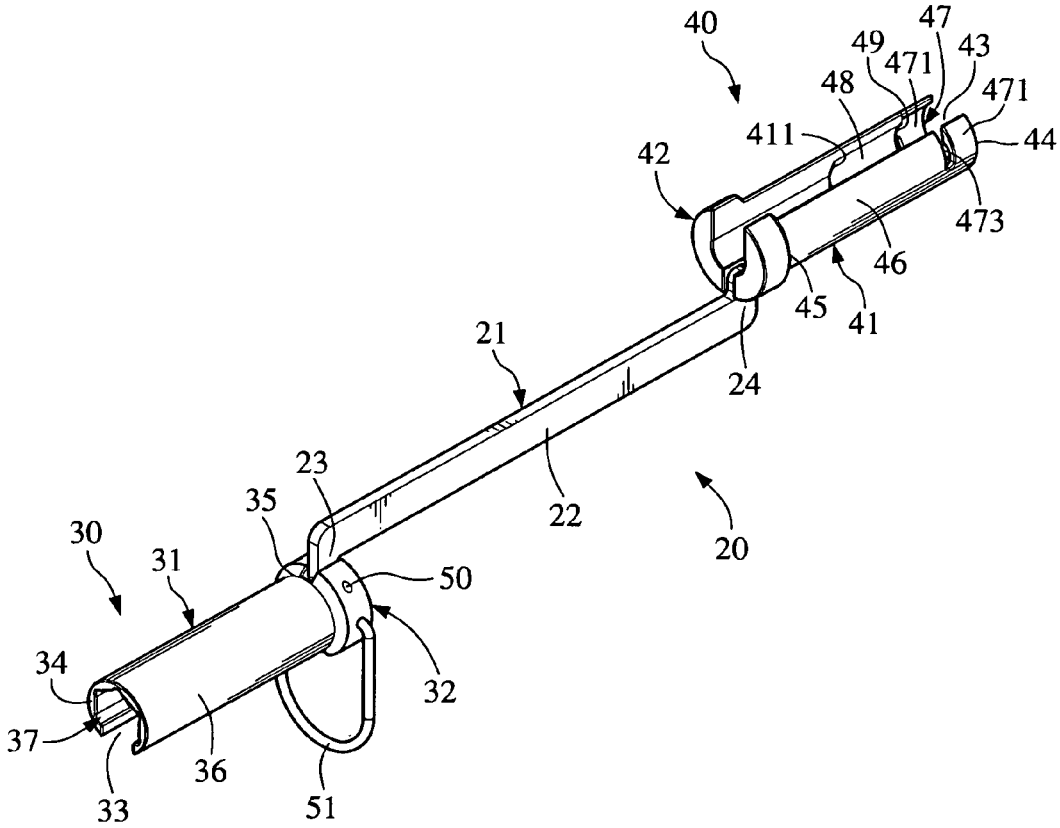
FIG. 2 is an assembled perspective view of a tool for installing and removing a male F connector according to a preferred embodiment of the present invention.
Figure 3:
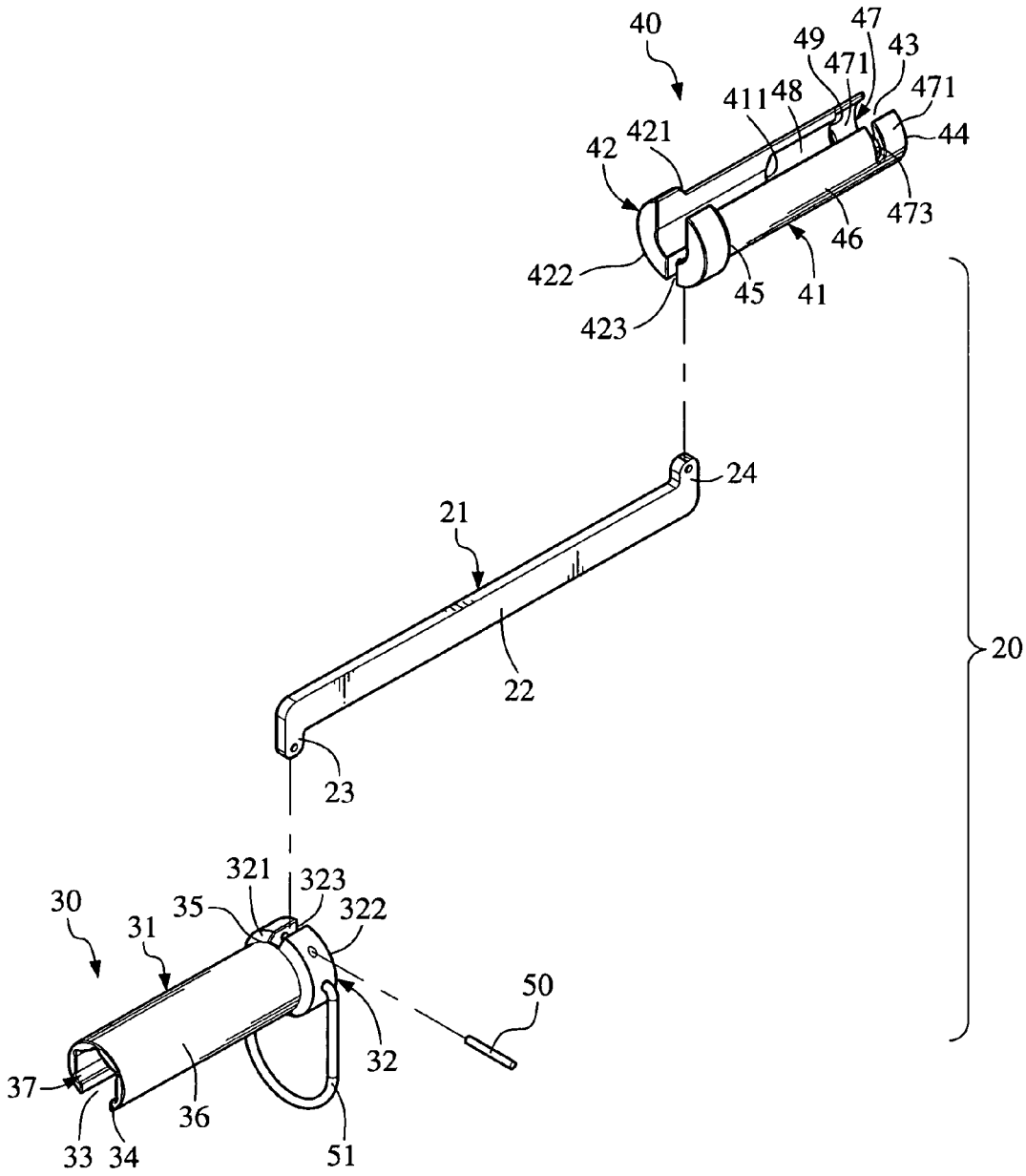
FIG. 3 is an exploded view of FIG. 2.

FIGS. 2 and 3 are assembled and exploded perspective views, respectively, of a tool for installing and removing male F-type coaxial cable connector according to a preferred embodiment of the present invention, which is generally denoted by reference numeral 20. As shown, the tool 20 includes an elongated plate-like link 21, a first socket wrench 30, and a second socket wrench 40. The link 21 includes a link body 22 having a first end 23 and a second end 24. The first and the second socket wrench 30, 40 are respectively a tubular member consisting of a wrench portion 31, 41 and a circular end portion 32, 42. Two slots 33, 43 are formed on the first and the second socket wrench 30, 40, respectively, to axially extend a full length of the wrench portions 31, 41 and the circular end portions 32, 42. That is, the slots 33, 43 respectively have a geometrical direction consistent with the axis direction of the wrench portions 31, 41 and the end portions 32, 42. The wrench portions 31, 41 each have a leading end 34, 44, a tail end 35, 45, and a hollow wrench body 36, 46 located between the leading end 34, 44 and the tail end 35, 45.

Figure 4:
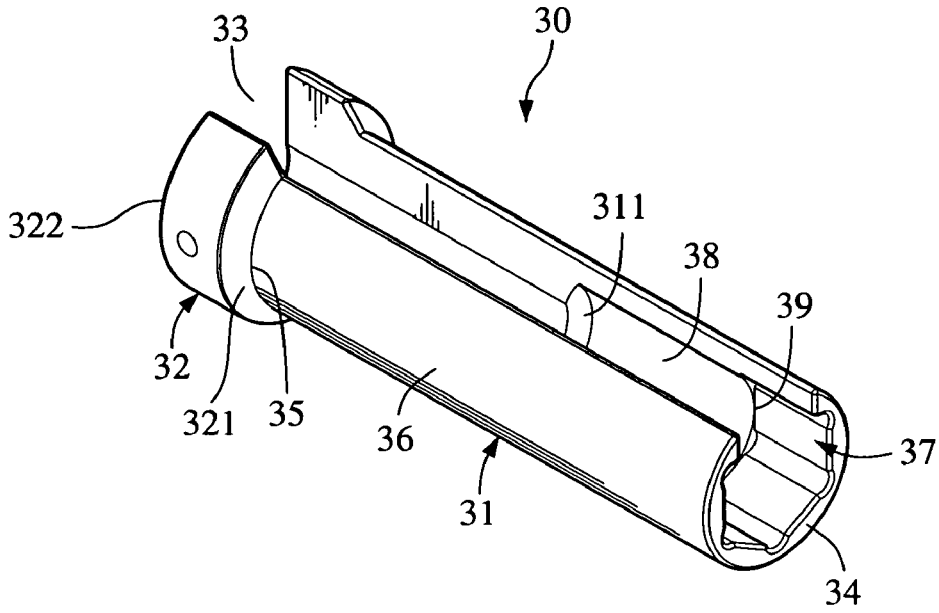
FIG. 4 is a perspective view of a first socket wrench of the tool of the present invention.

As can be seen from FIG. 4, the hollow wrench body 36 of the first socket wrench 30 is provided on an inner wall surface adjacent to the leading end 34 with a hexagonally shaped portion 37 for fitting around the hexagonally-shaped outer surface 14 of the connecting ring 12 on the male F connector 11, and a receiving portion 38 behind the hexagonally shaped portion 37 for receiving the sleeve assembly 15 of the male F connector 11 therein. The first socket wrench 30 can be used to tighten or loosen the male F connector 11 to or from a female F connector.

Figure 5:
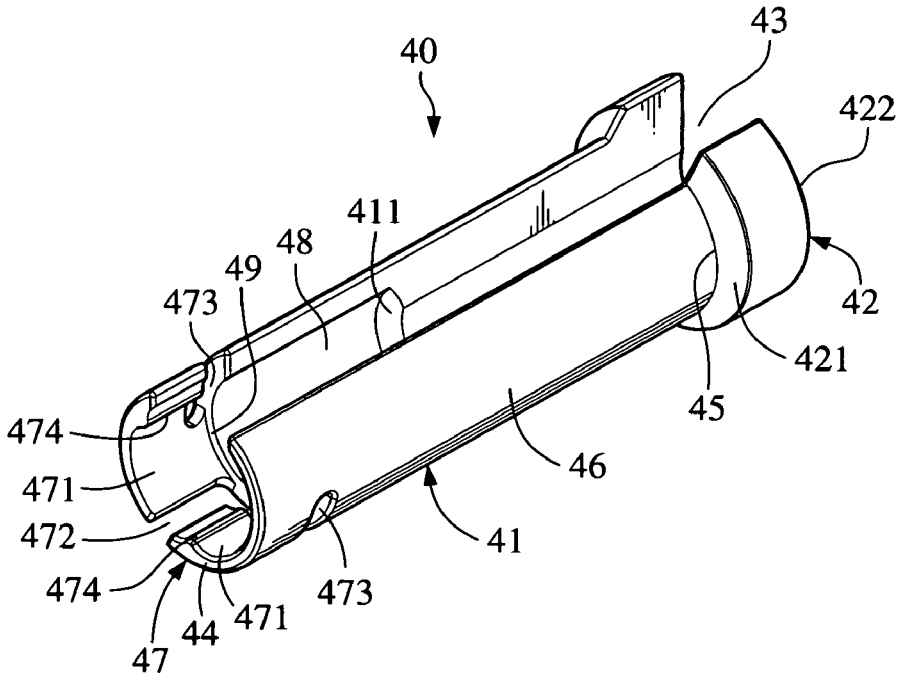
FIG. 5 is a perspective view of a second socket wrench of the tool of the present invention.
Figure 6:
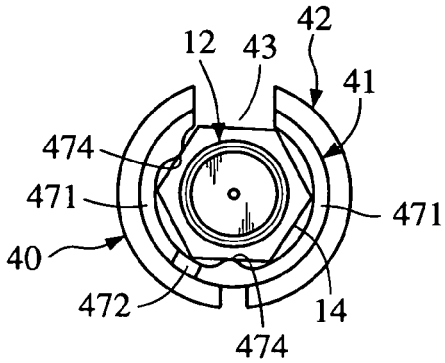
FIG. 6 is an end view of the second socket wrench of FIG. 5 with a connecting ring on a male F connector received therein.

As can be seen from FIG. 5, the hollow wrench body 46 of the second socket wrench 40 includes a constant-torque shaped portion 47 adjacent to the leading end 44 for fitting around the hexagonally-shaped outer surface 14 of the connecting ring 12 on the male F connector 11, and a receiving portion 48 behind the constant-torque shaped portion 47 for receiving the sleeve assembly 15 of the male F connector 11 therein. The constant-torque shaped portion 47 is an elastic structure having one axial slit 472 and two radial slits 473 to thereby produce two elastic plates 471. Each of the elastic plates 471 is formed on an inner wall surface with at least one axially extended and radially raised rib or protrusion 474 for tightly contacting with the hexagonally-shaped outer surface 14 of the connecting ring 12 fitted in the constant-torque shaped portion 47. In the illustrated FIG. 6, one rib 474 is internally formed on each of the two elastic plates 471. When using the constant-torque shaped portion 47 of the tool 20 to install the male F connector 11, it is able to avoid wearing of the hexagonally-shaped outer surface 14 of the connecting ring 12 caused by excessively applied torsion force. Once the torque for tightening the male F connector 11 exceeds a preset torque value, the two elastic plates 471 are forced outward to flare, bringing the constant-torque shaped portion 47 to separate from the hexagonally-shaped outer surface 14 of the connecting ring 12 and no longer tightly fit around the outer surface 14. In this situation, the tool 20 can no longer be used to turn the connecting ring 12. In brief, the second socket wrench 40 provides a limit value to the tightening torque.

Further, the wrench bodies 36, 46 are respectively provided on an inner wall surface with a first stepped stop 39, 49 and a second stepped stop 311, 411. When the tool 20 is moved forward along the male F connector 11, the first stepped stop 39, 49 will press against a rear end of the connecting ring 12, preventing the hexagonally shaped portion 37 or the constant-torque shaped portion 47 of the wrench portion 31 or 41 from moving beyond the connecting ring 12; and the second stepped stop 311, 411 will press against a rear end of the sleeve assembly 15, so that the sleeve assembly 15 is located in the receiving portion 38, 48.

Figure 7:
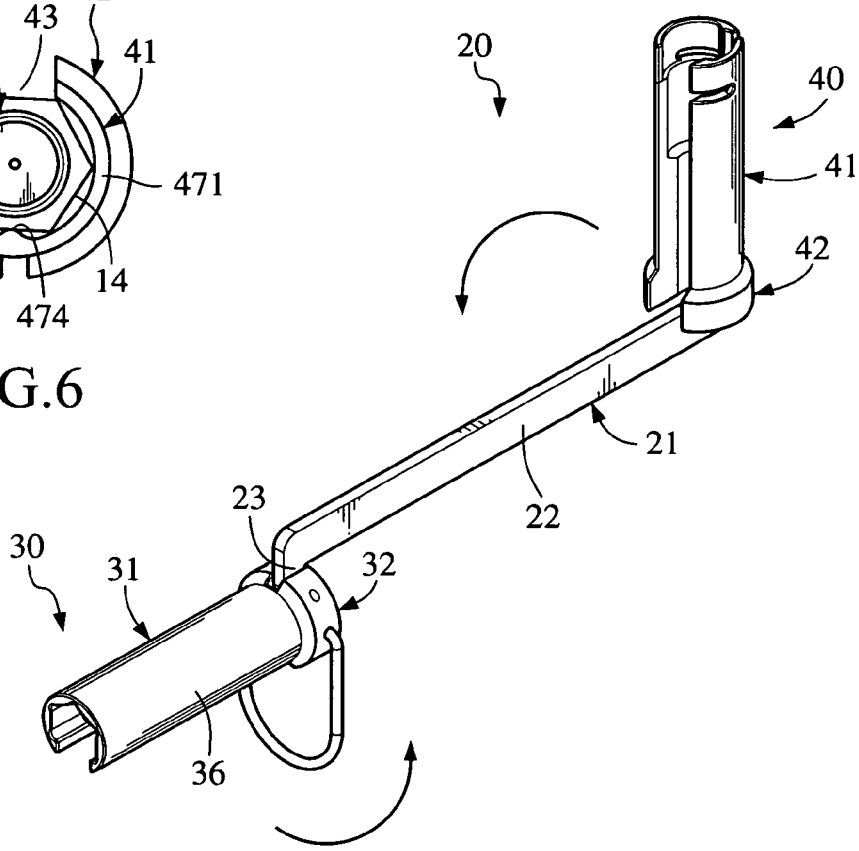
FIG. 7 is a perspective view showing the tool of the present invention in use.
Figure 8:
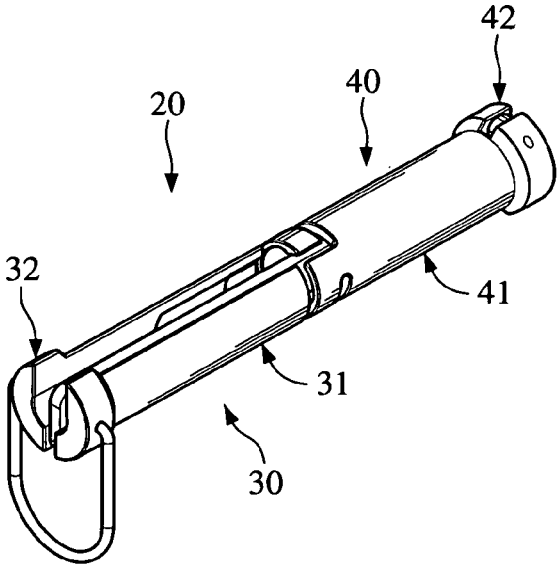
FIG. 8 is a perspective view showing the tool of the present invention not in use can be turned into a folded position.

The circular end portions 32, 42 each are a hollow element having a leading end 321, 421 and a tail end 322, 422. The leading ends 321, 421 are adjoining the tail ends 35, 45 of the wrench portions 31, 41, respectively, so that the slots 33, 43 are extended from the wrench portions 31, 41 to the circular end portions 32, 42. As can be most clearly seen from FIGS. 7 and 8, the circular end portions 32, 42 each are provided with a connecting slot 323, 423 axially extending from the leading end 321, 421 to the tail end 322, 422. The link body 22 is connected at the first end 23 and the second end 24 to the connecting slots 323 and 423, respectively, by separately extending two pivot shafts 50 through the circular end portion 32 and the first end 23 as well as the circular end portion 42 and the second end 24, so that the first and the second socket wrench 30, 40 can be pivotally turned about the pivot shaft 50 from an extended position as shown in FIG. 7 to a folded position as shown in FIG. 8.

The tool 20 further includes a hanger 51 connected to the first socket wrench 30 or the second socket wrench 40. In the illustrated embodiment as shown in FIG. 2, the hanger 51 is connected to the circular end portion 32 of the first socket wrench 30, so that the tool 20 can be conveniently hung to a desired position.

Figure 9:
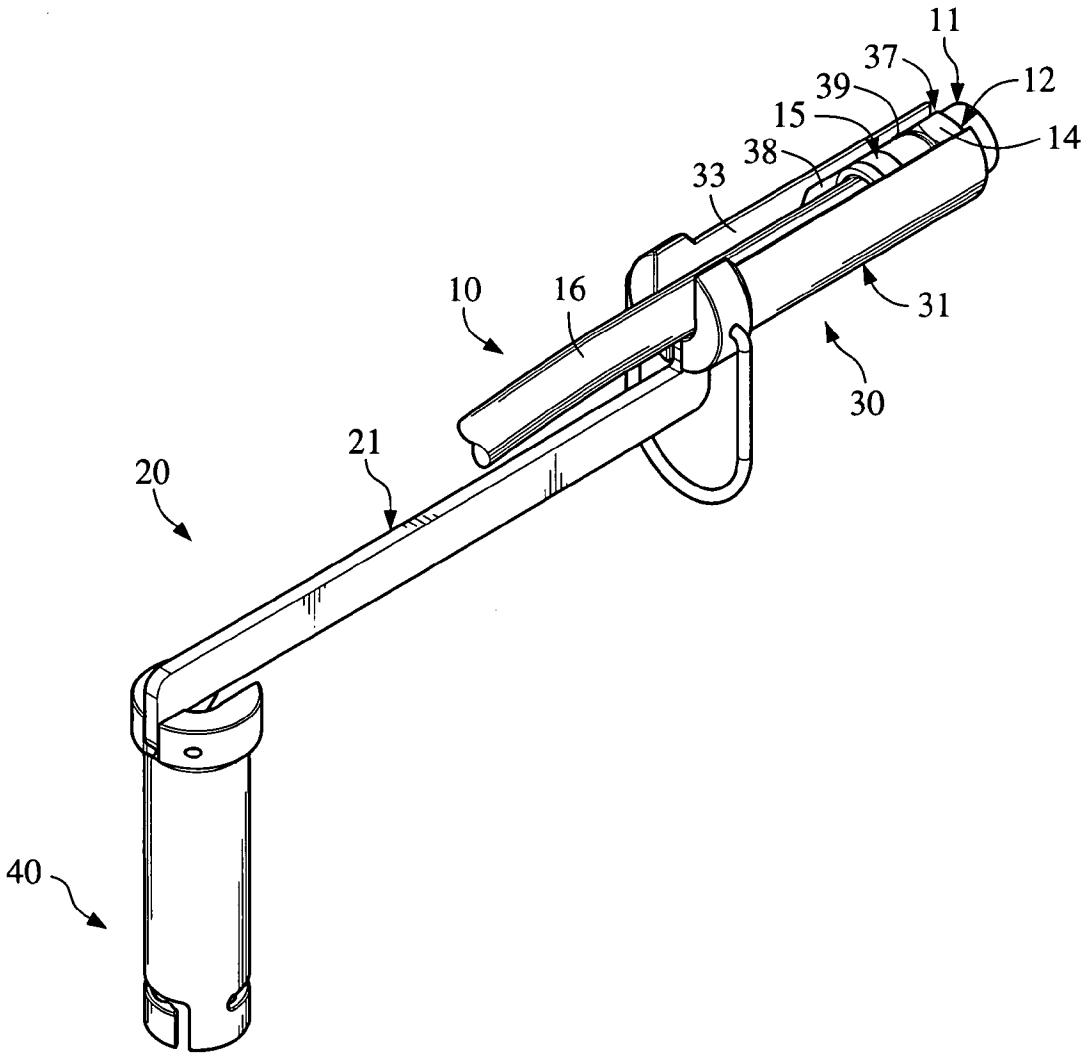
FIG. 9 shows the use of the first socket wrench of the tool of the present invention to install a male F connector.

FIG. 9 is a perspective view showing an F-type coaxial cable structure 10 is associated with the first socket wrench 30 on the tool 20. As shown, the male F connector 11 is received in the slot 33 on the tubular wrench portion 31 with the connecting ring 12 located in the hexagonally shaped portion 37 and the sleeve assembly 15 located in the receiving portion 38, and the coaxial cable 16 is extended outward from the wrench portion 31 and can be connected to a desired electronic device (not shown).

Figure 10:
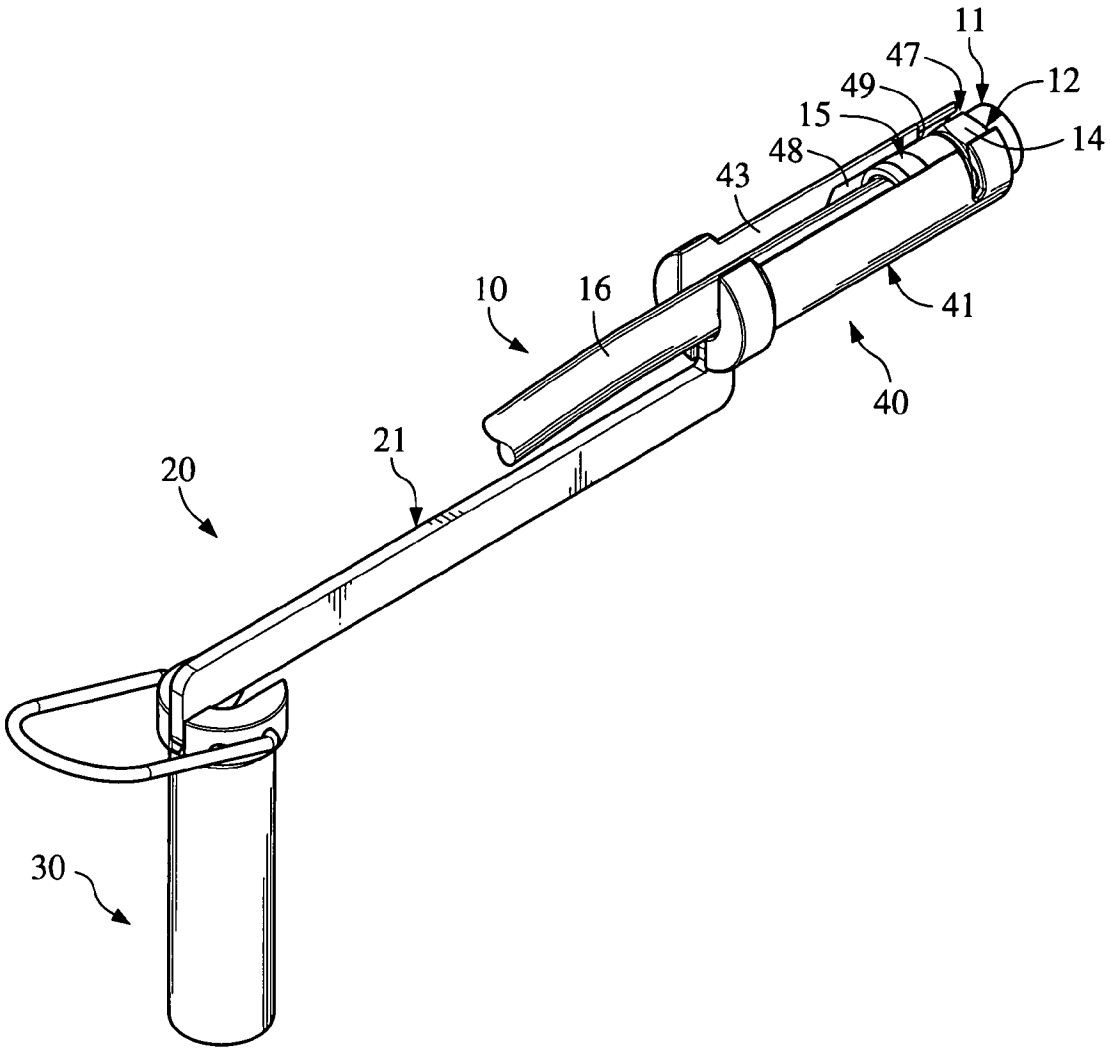
FIG. 10 shows the use of the second socket wrench of the tool of the present invention to install a male F connector.

FIG. 10 is a perspective view showing an F-type coaxial cable structure 10 is associated with the second socket wrench 40 on the tool 20. As shown, the male F connector 11 is received in the slot 43 on the tubular wrench portion 41 with the connecting ring 12 located in the constant-torque shaped portion 47 and the sleeve assembly 15 located in the receiving portion 48, and the coaxial cable 16 is extended outward from the wrench portion 41 and can be connected to a desired electronic device (not shown).

The position of the hexagonally shaped portion 37 of the wrench portion 31 and the circular end portion 32 as well as the position of the constant-torque shaped portion 47 of the wrench portion 41 and the circular end portion 42 relative to the F-type coaxial cable structure 10 are clearly shown in FIGS. 9 and 10, respectively. From FIGS. 9 and 10, it can be seen that the coaxial cable 16 would not interfere with or hinder the tool 20 when the tool 20 is turned to tighten or loosen the male F connector 11 to or from a female F connector. In the case of using a conventional crescent-shaped wrench to start loosening or to do final tightening of the connecting ring 12, the conventional crescent-shaped wrench will inevitably be interfered or hindered by neighboring cables and can not be continuously turned as necessary. However, with the tool 20 of the present invention, an operator can easily manipulate the first wrench 30 or the second wrench 40 to continuously turn the connecting ring 12 to install or remove the male F connector 11 to or from a female F connector. Even if there is a plurality of bent or densely arranged cables located near the male F connector 11 being handled, the tool 20, due to the high mechanical advantage thereof, can still produce appropriate torque to loosen or tighten the connecting ring 12.

Figure 11:
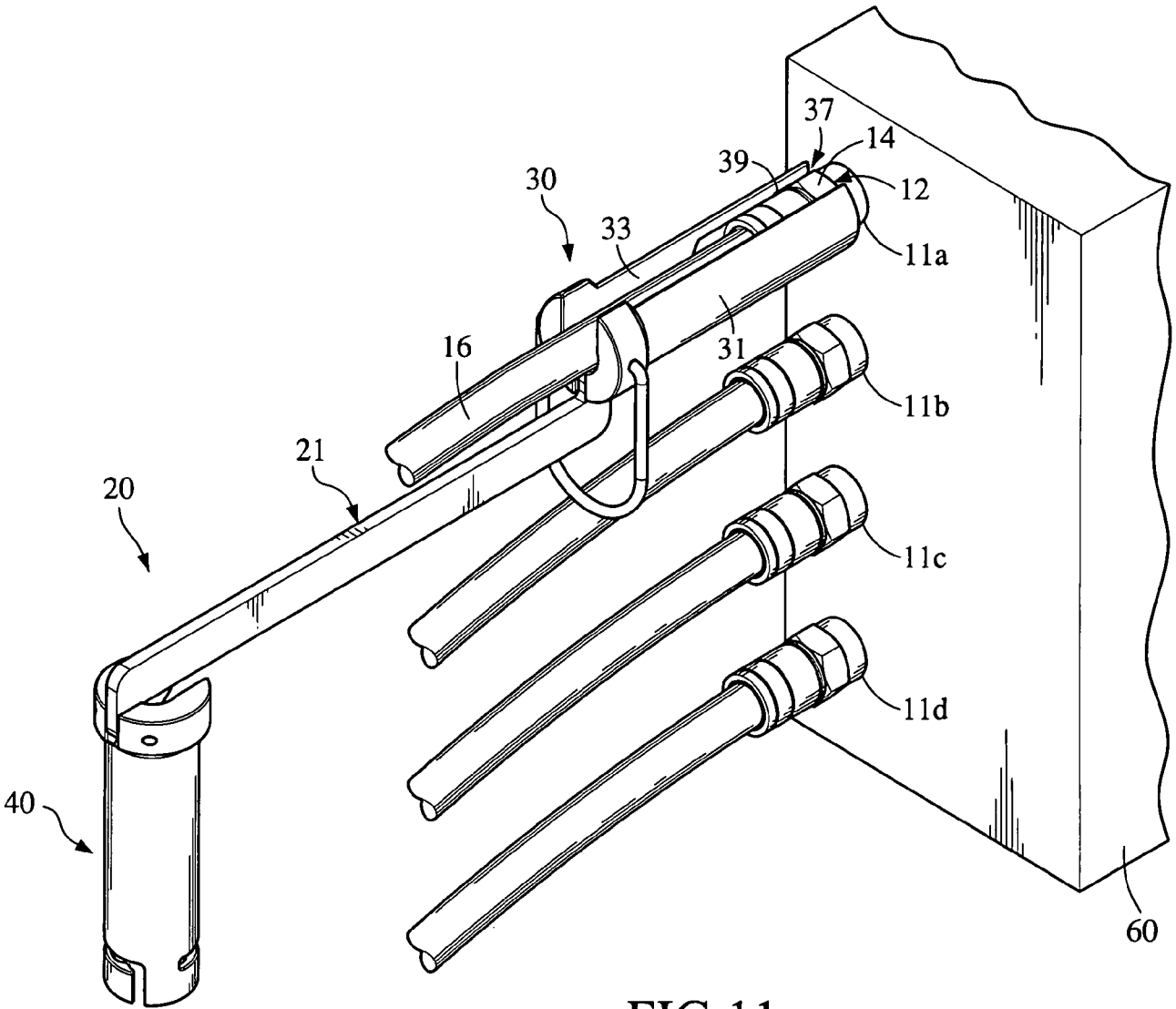
FIG. 11 is a fragmentary perspective view showing an electronic device having a plurality of female F connectors provided thereon and the use of the first socket wrench of the tool of the present invention to install or remove a male F connector to or from one of the female F connectors.
Figure 12:
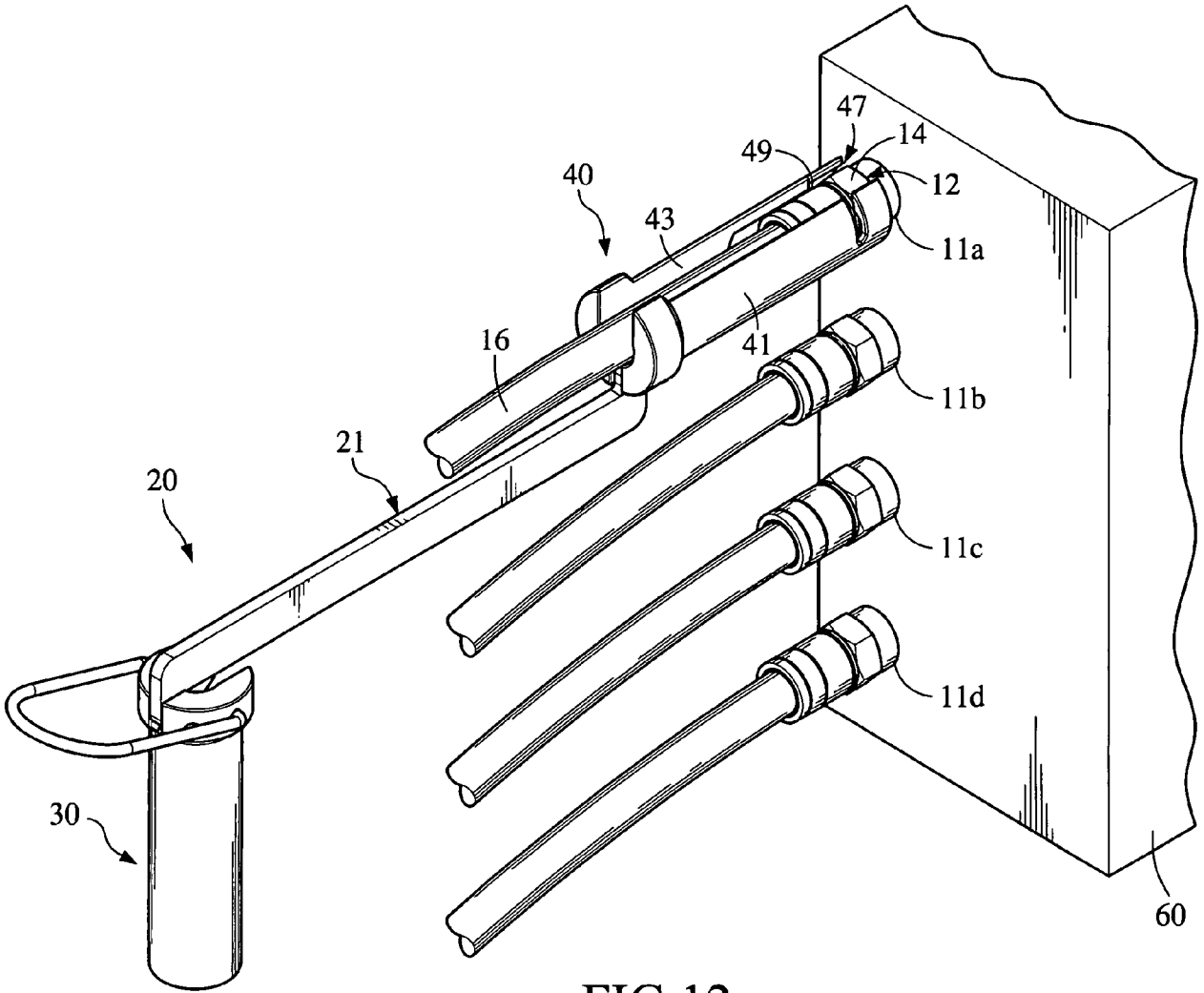
FIG. 12 is a fragmentary perspective view showing an electronic device having a plurality of female F connectors provided thereon and the use of the second socket wrench of the tool of the present invention to install or remove a male F connector to or from one of the female F connectors.

FIGS. 11 and 12 clearly show the manner of manipulating the tool 20 of the present invention. As shown in FIGS. 11 and 12, there is an electronic device 60 having a plurality of densely arranged female F connectors provided thereon, and a plurality of male F connectors 11*a*, 11*b*, 11*c* and 11*d* being separately connected to the female F connectors. An operator can select to use the first socket wrench 30 or the second socket wrench 40 on the tool 20, and bear the selected socket wrench 30 or 40 on the electronic device 60 having the female F connectors provided thereon. In FIG. 11, the first socket wrench 30 is selected for use, and in FIG. 12, the second socket wrench 40 is selected for use. The selected first or second socket wrench 30 or 40 can be used to connect a male F connector to one of the female F connectors on the electronic device 60, or to remove a male F connector from one of the female F connectors on the electronic device 60. In the illustrated embodiment, the coaxial cables 16 connected to the male F connectors 11*a* to 11*d* are bent and highly close to one another. A bent coaxial cable 16 not only has influence on a lateral force applied to the male F connector thereof, but also increases the torque needed to turn the connecting ring 12. To use the tool 20, first dispose the coaxial cable 16 in the selected first or second socket wrench 30 or 40 via the slot 33 or 43. Then, move the socket wrench 30 or 40 forward along the length direction of the cable 16 until the first stepped stop 39 or 49 of the wrench portion 31 or 41 is fully pressed against the rear end of the connecting ring 12. When the first or the second socket wrench 30 or 40 on the tool 20 has been located around the male F connector to be handled, the hexagonally shaped portion 37 or the constant-torque shaped portion 47 of the tool 20 will snugly fit around the hexagonally-shaped outer surface 14 of the connecting ring 12. Then, grip at the first or the second socket wrench 30 or 40 with fingers, and turn the tool 20 clockwise to install the male F connector 11*a*-11*d* on the female F connector on the electronic device 60, or turn the tool 20 counterclockwise to remove the male F connector from the female F connector on the electronic device 60. When operating the tool 20, the first or the second socket wrench 30 or 40 that is not in use, as shown in FIG. 12 and FIG. 11, respectively, can be pivotally turned about the pivot shaft 50 thereof by 90 degrees to thereby serve as a force applying end. The torque produced via this mechanical advantage enables the operator to efficiently tighten or loosen the connecting ring 12 on the male F connector to or from the corresponding female F connector on the electronic device 60.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A tool for installing and removing a male F connector to or from a female F connector, the male F connector including a connecting ring rotatably located at a leading end thereof and a sleeve assembly located behind the connecting ring, and being connected at a tail end to an end of a coaxial cable to provide an F-type coaxial cable structure, the connecting ring having a threaded inner surface and a hexagonally-shaped outer surface, and the coaxial cable being extended outward from the tail end of the male F connector; the tool comprising:

a link including a link body having a first end and a second end;

a first socket wrench being connected to the first end of the link, and including a wrench portion and a circular end portion; the wrench portion being a tubular element having a leading end, a tail end, and a hollow wrench body located between the leading end and the tail end; the wrench body having a slot extended from the leading end to the tail end, and being provided on an inner wall surface adjacent to the leading end with a hexagonally shaped portion for fitting around the hexagonally-shaped outer surface of the connecting ring; the circular end portion being a hollow element having a leading end and a tail end, the leading end of the circular end portion being adjoining the tail end of the wrench portion, and the circular end portion having a slot extended between the leading end and the tail end thereof to lead to and communicate with the slot on the wrench portion; and a second socket wrench being connected to the second end of the link, and including a wrench portion and a circular end portion; the wrench portion being a tubular element having a leading end, a tail end, and a hollow wrench body located between the leading end and the tail end; the wrench body having a slot extended from the leading end to the tail end, and being provided on an inner wall surface adjacent to the leading end with a constant-torque shaped portion for fitting around the hexagonally-shaped outer surface of the connecting ring, such that when the second socket wrench applies a tightening torque exceeded a preset torque value, the constant-torque shaped portion is forced to separate from the connecting ring; the circular end portion being a hollow element having a leading end and a tail end, the leading end of the circular end portion being adjoining the tail end of the wrench portion, and the circular end portion having a slot extended between the leading end and the tail end thereof to lead to and communicate with the slot on the wrench portion.

2. The tool for installing and removing a male F connector as claimed in claim 1, wherein the wrench portion of each of the first and the second socket wrench is provided on an inner wall surface with a first stepped stop for pressing against a rear end of the connecting ring to avoid the hexagonally shaped portion and the constant-torque shaped portion from moving beyond the connecting ring.

3. The tool for installing and removing a male F connector as claimed in claim 1, wherein the constant-torque shaped portion is an elastic structure.

4. The tool for installing and removing a male F connector as claimed in claim 3, wherein the elastic structure includes one axial slit and two radial slits to thereby produce two elastic plates.

5. The tool for installing and removing a male F connector as claimed in claim 4, wherein each of the two elastic plates is provided on an inner wall surface with at least one rib for tightly contacting with the hexagonally-shaped outer surface of the connecting ring.

6. The tool for installing and removing a male F connector as claimed in claim 1, wherein the circular end portion of the first socket wrench has a hanger connected thereto.

7. The tool for installing and removing a male F connector as claimed in claim 1, wherein the circular end portion of the second socket wrench has a hanger connected thereto.

8. The tool for installing and removing a male F connector as claimed in claim 1, wherein the circular end portion of each of the first and the second socket wrench is provided with a connecting slot; the link body being connected at the first end to the connecting slot on the first socket wrench via a pivot shaft extended through the circular end portion of the first socket wrench and the first end of the link body, and the link body being connected at the second end to the connecting slot on the second socket wrench via a pivot shaft extended through the circular end portion of the second socket wrench and the second end of the link body, so that the first and the second socket wrench are pivotally turnable about the pivot shafts relative to the link from an extended position to a folded position.

9. The tool for installing and removing a male F connector as claimed in claim 2, wherein the wrench portion of each of the first and the second socket wrench is provided on the inner wall surface with a second stepped stop behind the first stepped stop for pressing against a rear end of the sleeve assembly of the male F connector, so that the sleeve assembly can locate in a receiving portion of the wrench portion behind the hexagonally shaped portion in the case of the first socket wrench or behind the constant-torque shaped portion in the case of the second socket wrench.

* * * * *